United States Patent [19]

Satoh

[11] 4,386,340

[45] May 31, 1983

[54] MELODY GENERATION IN AN ELECTRONIC CASH REGISTER

[75] Inventor: Masaharu Satoh, Nara, Japan

[73] Assignee: Sharp Kabushiki Kaisha, Osaka, Japan

[21] Appl. No.: 198,648

[22] Filed: Oct. 20, 1980

[30] Foreign Application Priority Data

Oct. 23, 1979 [JP] Japan ..... 54-148496[U]
Mar. 24, 1980 [JP] Japan ..... 55-38006
Mar. 25, 1980 [JP] Japan ..... 55-38751

[51] Int. Cl.[3] ..... G08B 21/00
[52] U.S. Cl. ..... 340/384 E
[58] Field of Search ..... 340/384 E, 147 R; 368/251, 272; 179/1 SM; 364/705, 405; 434/230; 235/22; 46/175 R, 175 AR

[56] References Cited

U.S. PATENT DOCUMENTS 3,744,022 7/1973 Olsen ..... 340/384 E
4,060,848 11/1977 Hyatt ..... 364/405
4,142,235 2/1979 Tadakuna et al. ..... 364/405
4,179,584 12/1979 Tanimoto et al. ..... 179/1 SM
4,185,169 1/1980 Tanimoto et al. ..... 179/1 SM
4,194,176 3/1980 Fukuma ..... 340/147 R
4,267,586 5/1981 Uchino et al. ..... 368/272

*Primary Examiner*—Gerald L. Brigance
*Attorney, Agent, or Firm*—Birch, Stewart, Kolasch & Birch

[57] ABSTRACT

An electronic cash register includes a melody generation system for generating a melody for as long as the cash box is open. Information corresponding to a plurality of melodies is stored in the melody generation system for changing the melody in accordance with a certain condition. In a preferred form, a first melody is generated when the current time has not yet reached a preselected time, and a second melody is generated when the current time has already reached the preselected time. In another preferred form, the melody is changed when the clerk who handles the electronic cash register changes.

2 Claims, 4 Drawing Figures

MELODY GENERATION IN AN ELECTRONIC CASH REGISTER

BACKGROUND AND SUMMARY OF THE INVENTION

The present invention relates to an electronic cash register and, more particularly, to a melody generation system in an electronic cash register.

It is conventional to generate a buzzer sound at a time when a cash box is opened in an electronic cash register. In such a system, there is no alarm system signaling the condition wherein the cash box is erroneously left open.

Accordingly, an object of the present invention is to provide an electronic cash register which develops a preselected melody sound as long as a cash box is maintained in an open condition.

Another object of the present invention is to provide a melody generation system in an electronic cash register for selectively generating a desired melody sound when the cash box is opened.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a melody generation system is provided in an electronic cash register. A control system is provided for developing an enabling signal when a cash box is held in an open condition, and a disabling signal when a cash box is held in a closed condition. The enabling signal and the disabling signal are applied to the melody generation system for developing a melody sound as long as the cash box is maintained in an open condition.

In a preferred form, the melody generation system can develop several melodies. A time keeping system is provided in an electronic cash register for automatically changing the melody generated by the melody generation system depending on the current time information.

In another preferred form, an electronic cash register includes a cashier identifying system for identifying a clerk who handles the electronic cash register. A selection system is responsive to the cashier identifying system for generating a specific melody stored in the melody generation system when a specific clerk handles the electronic cash register. Of course, each melody is assigned to a respective clerk so that a different melody is generated when a different clerk handles the electronic cash register.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
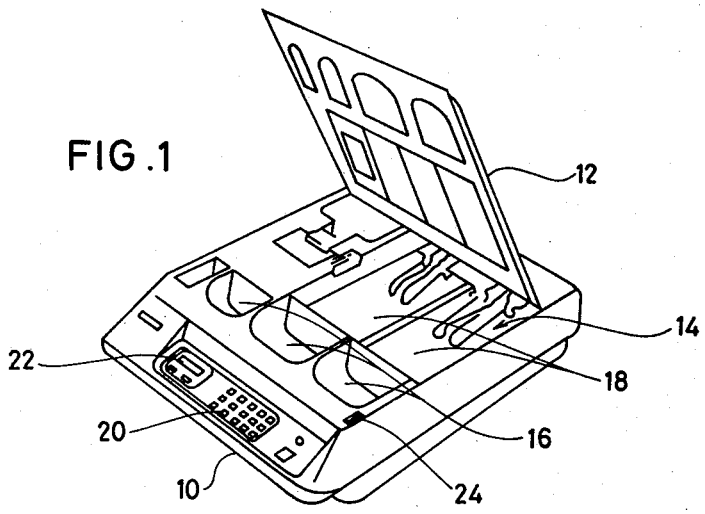
FIG. 1 is a perspective view of an embodiment of an electronic cash register of the present invention.

An electronic cash register of the present invention comprises a main housing 10, and a rotatable cover 12 opening and closing to provide selective access to a cash box 14. The cash box 14 comprises coin reservoirs 16 and bill reservoirs 18. A key input unit 20 and a display unit 22 are disposed on a front panel of the main housing 10. A microswitch 24 is secured to the main housing 10 for detecting the opened and closed positions of the rotatable cover 12. More specifically, the microswitch 24 is ON when the rotatable cover 12 is open, and is OFF when the rotatable cover 12 is closed.

Figure 2:
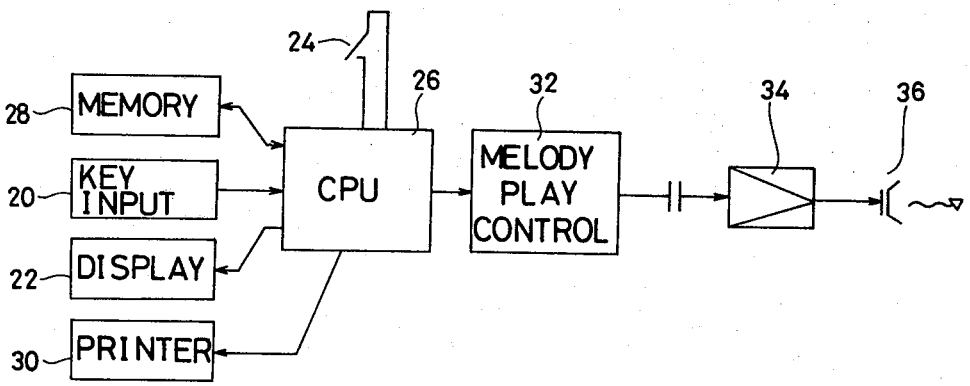
FIG. 2 is a block diagram of an embodiment of a melody generation control system included in the electronic cash register of FIG. 1.

FIG. 2 shows an essential part of the electronic cash register, and an embodiment of a melody generation control system included in the electronic cash register. Like elements corresponding to those of FIG. 1 are indicated by like numerals.

The key input unit 20 and the display unit 22 are connected to a central processor unit 26. A main memory 28 is also connected to the central processor unit 26 for storing the transaction data, and a printer 30 is connected to the central processor unit 26 for printing out the transaction data on a journal paper and/or receipt slip. A switching signal derived from the microswitch 24 is applied to the central processor unit 26 for developing a play instruction signal to a melody play control circuit 32. The melody play control circuit 32 comprises an LSI chip which stores information related to several melody pieces. In response to the play instruction signal, the melody play control circuit 32 develops preselected melody information to an amplifier 34 for generating the melody sound through a speaker 36.

When the rotatable cover 12 is opened to expose the cash box 14, the microswitch 24 is switched on. The central processor unit 26 develops the play instruction signal toward the melody play control circuit 32, thereby generating the melody sound from the speaker 36. When the rotatable cover 12 is closed, the microswitch 24 is switched off. The development of the play instruction signal from the central processor unit 26 is terminated, whereby the generation of the melody sound is terminated. In this way, the melody sound is generated as long as the rotatable cover 12 is open.

Figure 3:
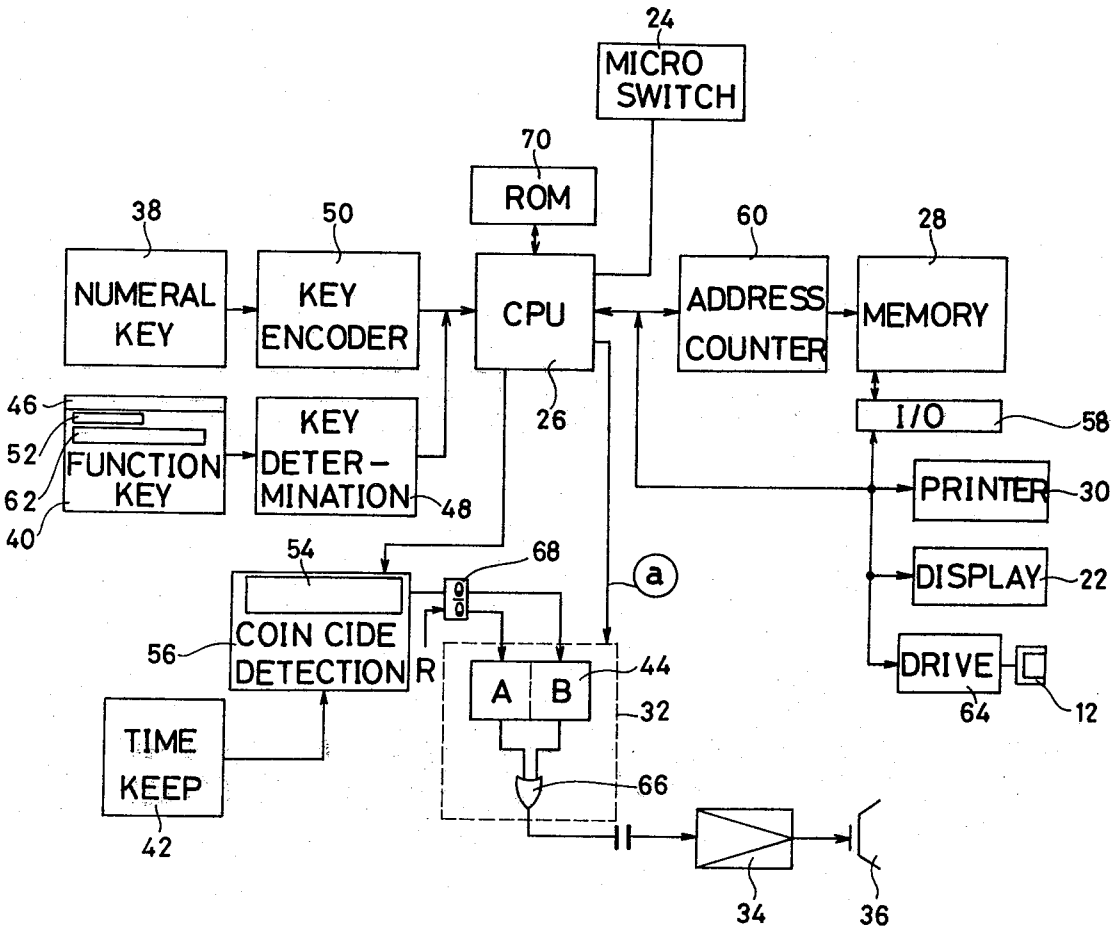
FIG. 3 is a block diagram of another embodiment of a melody generation control system included in the electronic cash register of FIG. 1.

FIG. 3 shows an essential part of another embodiment of the electronic cash register of the present invention, wherein the melody sound is changed depending on the current time information. Like elements corresponding to those of FIGS. 1 and 2 are indicated by like numerals.

The key input unit includes numeral keys 38 and function keys 40. A time information keeping circuit 42 is included in the electronic cash register for storing the current time information. The melody play control circuit 32 includes an LSI chip 44 which stores information A related to a first melody and information B related to a second melody which is different from the first melody.

To preset a time at which the melody is to be changed, a mode switch 46 included in the function keys 40 is selected to the preset mode. The preset mode signal is applied to the central processor unit 26 via a key determination circuit 48. Then, a desired time, for example, 6 o'clock, at which the melody kind should be changed is introduced from the numeral keys 38 by actuating a numeral key "6". The numeral information is applied to the central processor unit 26 via a key encoder 50. Then, a time set key 52 included in the funtion keys 40 is actuated to indicate that the introduced numeral information is the time information. In response to the actuation of the time set key 52, the central processor unit 26 functions to apply the set time information "6" to a storage circuit 54 included in a coincide detection circuit 56 for storing the set time information in the storage circuit 54. In this way, the preset invention is completed.

In the normal registration operation mode, the mode switch 46 is switched to the normal registration mode. Numeral information related to the transaction is first introduced from the numeral keys 38 to the central processor unit 26 via the key encoder 50. A predetermined department key included in the function keys 40 is actuated to indicate the related department through the key determination circuit 48. The numeral information is introduced into the main memory 28 through an input/output circuit 58 and stored in a desired memory section selected by an address counter 60. The transaction information is displayed on the display unit 22 and printed on a journal paper and/or a receipt slip by the printer 30.

When the registration operation related to one customer is completed, a total key 62 is actuated, whereby the central processor unit 26 functions to total the money information stored in the main memory 28. The total money information is introduced to and stored in a desired memory section in the main memory 28, displayed on the display unit 22, and printed on the journal paper and/or the receipt slip by the printer 30. In response to the actuation of the total key 62, the central processor unit 26 develops a drive instruction toward a driver circuit 64 to open the rotatable cover 12.

When the rotatable cover 12 is opened, the microswitch 24 is switched on and, therefore, the central processor unit 26 develops an enabling signal ⓐ toward the melody play control circuit 32. At this moment, if the current time information has already reached the set time information stored in the storage circuit 54, the second melody information B is developed through an OR gate 66 because a flip-flop 68 is placed in the set condition by the coincide detection circuit 56. Contrarily, if the current time information has not yet reached the set time information stored in the storage circuit 54, the first melody information A is generated from the speaker 36 because the flip-flop 68 is held in the reset condition.

The melody generation is terminated when the rotatable cover 12 is closed and the enabling signal ⓐ disappears. The flip-flop 68 is automatically reset when the current time information reaches a preselected time, for example, zero o'clock. The operation of the electronic cash register is controlled by microprograms stored in a read only memory 70. Of course, it is possible to automatically change the melody weekly, or monthly if desired.

Figure 4:
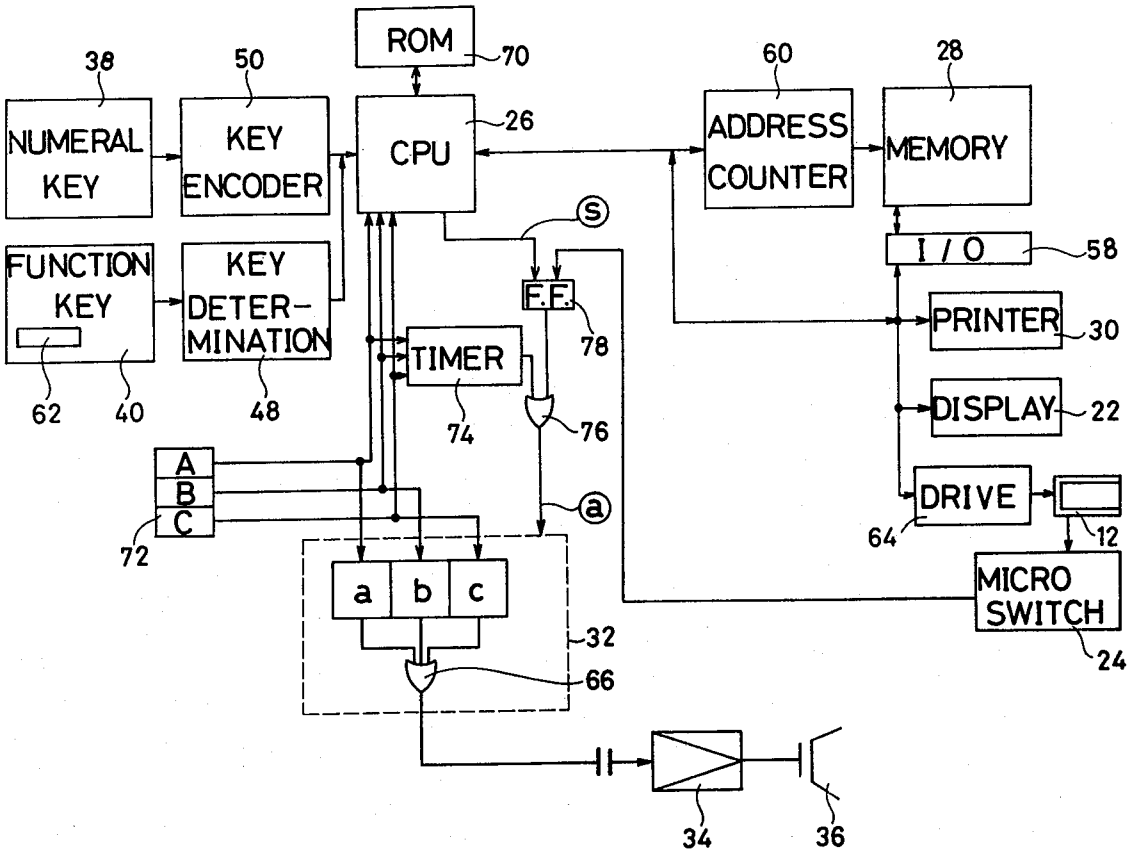
FIG. 4 is a block diagram of still another embodiment of a melody generation control system included in the electronic cash register of FIG. 1.

FIG. 4 shows an essential part of still another embodiment of the electronic cash register of the preset invention, wherein the melody sound is changed when the clerk who handles the electronic cash register changes. Like elements corresponding to those of FIG. 3 are indicated by like numerals.

When the clerk "A'" handles the electronic cash register, a clerk key "A" included in clerk selection keys 72 is depressed to indicate that the clerk "A'" is handling the electronic cash register. A typical construction of an electronic cash register including the cashier identifying administration system is disclosed in U.S. Pat. No. 4,194,176, "Cashier Identifying Administration in an Electronic Cash Register", issued on Mar. 18, 1980 and assigned to the same assignee as the present application.

When the clerk key "A" is depressed, a first melody "a" stored in the melody play control circuit 32 is selected, and a timer circuit 74 is enabled. The timer circuit 74 develops the enabling signal ⓐ for a predetermined period of time, for example, 10 sec., which is applied to the melody play control circuit 32 through an OR gate 76. Accordingly, the first melody "a" is generated from the speaker 36 for a predetermined period of time when the clerk "A'" starts to operate the electronic cash register. The normal registration operation is similar to that disclosed in U.S. Pat. No. 4,194,176.

When the registration operation related to one customer is completed, the total key 62 included in the function keys 40 is actuated, whereby the central processor unit 26 functions to total the money information related to the customer. The total money information is introduced into and accumulated in a memory section assigned to the clerk "A'" in the main memory 28. The total money information is displayed on the display unit 22, and printed on the journal paper and/or the receipt slip by the printer 30. In response to the actuation of the total key 62, the central processor unit 26 develops a drive instruction toward the driver circuit 64 to open the rotatable cover 12. At the same time, a set signal Ⓢ is developed from the central processor unit 26 to set a flip-flop 78. The set signal of the flip-flop 78 is applied to the melody play control circuit 32 through the OR gate 76 as the enabling signal ⓐ . When the rotatable cover 12 is closed, the microswitch 24 develops a detection signal to reset the flip-flop 78. In this way, the first melody "a" is generated from the speaker 36 as long as the cash box is exposed to the ambience when the clerk "A'" handles the electronic cash register.

A second melody "b" is selected when the clerk "B'" actuates the clerk key "B". A third melody "c" is selected when the clerk "C'" handles the electronic cash register. A preferred melody play control circuit 32 comprises a melody LSI "MN 6221" manufactured by Matsushita Electronics Corporation, which stores the information related to seven kinds of melodies.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A melody generation control system in an electronic cash register including a cash box for storing money therein, comprising:

state determination means for generating a first control signal when said cash box is open, and a second control signal when said cash box is closed;

melody storage means for storing a plurality of melodies therein;

teller identification means for identifying which of a plurality of tellers is using said machine, said teller identification means producing a teller identifying signal corresponding to the particular teller using said machine;

selection means responsive to said teller identification signal for selecting a different desired melody from said plurality of melodies for each teller;

control means for recalling said melody information stored in said melody storage means when said first control signal is generated by said state determination means; and audio means for generating an audio melody sound from the melody information recalled from said melody storage means.

2. An audible annunciator in an electronic cash register including a cash box, comprising:

cash box condition sensing means for indicating when said cash box is open and producing an open box signal in response thereto;

melody storage means for storing information indicative of respective different melodies;

melody generation means for recalling said information from said melody storage means and producing an audible melody in response thereto when said open box signal is produced by said cash box condition sensing means;

teller identification means for identifying which of a plurality of tellers is using said machine, said teller identification means producing a teller identifying signal corresponding to the particular teller using said machine;

said melody generation means recalling information indicative of one of said different melodies, the melody recalled being uniquely associated with the teller identifying signal produced by said teller identification means and associated with one of said plurality of tellers.

* * * * *